US008982008B2

(12) United States Patent
Parsche

(10) Patent No.: US 8,982,008 B2
(45) Date of Patent: Mar. 17, 2015

(54) WIRELESS COMMUNICATIONS DEVICE INCLUDING SIDE-BY-SIDE PASSIVE LOOP ANTENNAS AND RELATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 863 days.

(21) Appl. No.: 13/076,587

(22) Filed: Mar. 31, 2011

(65) Prior Publication Data

US 2012/0249396 A1 Oct. 4, 2012

(51) Int. Cl.

| | |
|---|---|
| ***H01Q 7/00*** | (2006.01) |
| ***H01Q 1/24*** | (2006.01) |
| ***H01Q 5/00*** | (2006.01) |
| ***H01Q 21/06*** | (2006.01) |

(52) U.S. Cl.

CPC ..... *H01Q 7/00* (2013.01); *H01Q 1/243* (2013.01); *H01Q 5/0065* (2013.01); *H01Q 21/061* (2013.01)

USPC ..... 343/866; 235/385; 340/10.1

(58) Field of Classification Search

USPC ..... 343/866; 235/385; 340/10.1

See application file for complete search history.

(56) References Cited

U.S. PATENT DOCUMENTS

| | | | | |
|---|---|---|---|---|
| 6,236,368 | B1 | 5/2001 | Johson | |
| 6,570,541 | B2 | 5/2003 | Dettloff | 373/742 |
| 6,788,261 | B1 * | 9/2004 | Buren | 343/715 |
| 7,432,874 | B2 | 10/2008 | Meissner | 343/867 |
| 7,755,546 | B2 | 7/2010 | Ishimiya | 343/702 |
| 2004/0100410 | A1 | 5/2004 | Tsai et al. | |
| 2005/0040232 | A1 * | 2/2005 | Maloney | 235/385 |
| 2005/0088342 | A1 | 4/2005 | Parsche | |
| 2007/0095926 | A1 * | 5/2007 | Zhu et al. | 235/492 |
| 2007/0139285 | A1 | 6/2007 | Maruyama et al. | |
| 2008/0100527 | A1 | 5/2008 | Rahim | 343/867 |
| 2009/0009414 | A1 | 1/2009 | Reykowski | 343/742 |
| 2009/0212774 | A1 | 8/2009 | Bosshard et al. | 324/309 |
| 2009/0322545 | A1 * | 12/2009 | Gibson et al. | 340/618 |

(Continued)

FOREIGN PATENT DOCUMENTS

JP 2006340246 12/2006

OTHER PUBLICATIONS

A.A. Pistolkors, Theory of the Circular Diffraction Antenna, Jan. 1948, pp. 56-60.

(Continued)

*Primary Examiner* — Allyson Trail

(74) *Attorney, Agent, or Firm* — Allen, Dyer, Doppelt, Milbrath & Gilchrist, P.A.

(57) ABSTRACT

A wireless communications device may include a housing, and wireless communications circuitry carried by the housing. The wireless communications device may also include an antenna assembly carried by the housing and coupled to the wireless communications circuitry. The antenna assembly may include a substrate and a plurality of passive loop antennas carried by the substrate and arranged in side-by-side relation. Each of the plurality of spaced apart passive loop antennas may include a passive loop conductor and a tuning element coupled thereto. The antenna assembly may also include an active loop antenna carried by the substrate and arranged to be at least partially coextensive with each of the plurality of passive loop antennas. The active loop antenna may include an active loop conductor and a pair of feedpoints defined therein.

23 Claims, 9 Drawing Sheets

(56) References Cited

U.S. PATENT DOCUMENTS

| | | | | |
|---|---|---|---|---|
| 2010/0093390 | A1* | 4/2010 | Waku et al. | 455/552.1 |
| 2010/0121180 | A1 | 5/2010 | Biber et al. | 600/422 |
| 2011/0084814 | A1* | 4/2011 | Ramsch | 340/10.32 |
| 2011/0210824 | A1* | 9/2011 | Stewart | 340/10.1 |
| 2012/0139705 | A1* | 6/2012 | Claessen | 340/10.1 |
| 2013/0023954 | A1* | 1/2013 | Meskens | 607/57 |

OTHER PUBLICATIONS

L.J. Chu, Physical Limitations of Omni-Directional Antennas, Dec. 1948, pp. 1163-1175.

* cited by examiner

WIRELESS COMMUNICATIONS DEVICE INCLUDING SIDE-BY-SIDE PASSIVE LOOP ANTENNAS AND RELATED METHODS

FIELD OF THE INVENTION

The present invention relates to the field of communications, and, more particularly, to antennas and related methods.

BACKGROUND OF THE INVENTION

Antennas may be used for a variety of purposes, such as communications or navigation, and portable radio devices may include broadcast receivers, pagers, or radio location devices ("ID tags"). The cellular telephone is an example of a wireless communications device, which is nearly ubiquitous. A relatively small size, increased efficiency, and a relatively broad radiation pattern are generally desired characteristics of an antenna for a portable radio or wireless device. Additionally, as the functionality of a wireless device continues to increase, so too does the demand for a smaller wireless device which is easier and more convenient for users to carry. One challenge this poses for wireless device manufacturers is designing antennas that provide desired operating characteristics within the relatively limited amount of space available for antennas. For example, it may be desirable for an antenna to communicate over multiple frequency bands and at lower frequencies.

Newer designs and manufacturing techniques have driven electronic components to relatively small dimensions and reduced the size of many wireless communication devices and systems. Unfortunately, antennas, and in particular, broadband antennas, have not been reduced in size at a comparable level and often are one of the larger components used in a smaller communications device.

Indeed, antenna size may be based upon operating frequency or frequencies. For example, an antenna may become increasingly larger as the operating frequency decreases. Reducing the wavelength may reduce the size of the antenna, but a longer wavelengths may be desired for enhanced propagation. At high frequencies (HF), 3 to 30 MHz for example, used for long-range communications, efficient antennas, for example, transmitting antennas, may become too large to be portable, and wire antennas may be required at fixed stations. Thus, it may become increasingly important in these wireless communication applications to reduce not only the antenna size, but also to design and manufacture a reduced size antenna having the greatest gain for the smallest area over the desired frequency bands.

The instantaneous 3 dB gain bandwidth, also known as half power fixed tuned radiation bandwidth, of electrically small antennas is thought to be limited under the Chu-Harrington limit ("Physical Limitations Of Omni-Directional Antennas, L. J. Chu, Journal of Applied Physics, Vol. 19, pp 1163-1175, December 1948). One form of Chu's Limit provides that the maximum possible 3 dB gain antenna bandwidth limited to $1600(\pi r/\lambda)^3$ percent, where r is the radius of the smallest sphere that can enclose the antenna, and $\lambda$ is the free space wavelength. This may be for single mode antennas matched into circuits. Unfortunately, such an antenna fitting inside a radius=$\lambda/20$ spherical envelope may not have more than 6.1% of this bandwidth. Further, practical antennas seldom approach the Chu's limit bandwidth. An example is a relatively small helix antenna enclosed by $r=\lambda/20$ sphere size operated at 1.2% bandwidth, e.g. ⅕ of Chu's Limit. Small antennas having increased bandwidth for size may thus be desired.

Canonical antennas include dipole and the loop antennas, in line and circle shapes. They translate and rotate electric currents to realize the divergence and curl functions, for example. Various coils may form hybrids of the dipole and the loop. Antennas may be linear, planar, or volumetric in form, e.g. they may be nearly 1, 2 or 3 dimensional. Optimal envelopes for antenna sizing may be Euclidian geometries such as a line, a circle, and a sphere, which may provide increased optimization of a relatively short distance between two points, increased area for circumference, and increased volume for decreased surface area respectively. It may be desirable to know the antennas that provide the greatest radiation bandwidth in these sizes. A broadband electrically large ($r>\lambda/2\pi$) antenna, for example, the spiral antenna, may provide a high pass response with theoretically unlimited bandwidth above a lower cutoff. At electrically small size, however, ($r<\lambda/2\pi$), the spiral may provide only a quadratic, bandpass type response with greatly limited bandwidth.

Planar antennas may be increasingly valuable for their ease of manufacture and product integration. The elementary planar dipole may be formed by radial electric currents flowing on a metal disc ("Theory Of The Circular Diffraction Antenna," A. A. Pistolkors, Proceedings of the Institute Of Radio Engineers, January 1948, pp 56-60). Circular and linear notches for feeding may be desired. A circle of wire may give the same radiation pattern, and it may be preferred for ease of driving. Elements to extend the bandwidth of wire loop antennas may be desired. Radio wave expansion occurs at the speed of light. If the speed of light were reduced, antenna size would also be reduced.

U.S. Patent Application Publication No. 2009/0212774 to Bosshard et al. discloses an antenna arrangement for a magnetic resonance apparatus. In particular, the antenna arrangement includes at least four individually operable antenna conductor loops arranged in a matrix (i.e. rows and columns) configuration. Two antenna conductor loops adjacent in a row or column are inductively decoupled from one another, while two antenna loops diagonally adjacent to one another are capacitively decoupled from one another.

U.S. Patent Application Publication No. 2009/0009414 to Reykowsi discloses an antenna array. The antenna array includes multiple individual antennas arranged next to one another. The individual antennas are arranged within a radio-frequency closed conductor loop with capacitors inserted in each conductor loop.

U.S. Patent Application Publication No. 2010/0121180 to Biber et al. discloses a head coil to a magnetic resonance device. A number of antenna elements are carried by a supporting body. The supporting body has an end section that is shaped as a spherical cap. A butterfly antenna is mounted at the end of the section, and is annularly surrounded by at least one group antenna that overlaps the butterfly antenna. However, none of these approaches are focused on providing an antenna with multi-band frequency operation, while being small in size, and having desired gain for area.

SUMMARY OF THE INVENTION

In view of the foregoing background, it is therefore an object of the present invention to provide a relatively small size multi-band antenna.

This and other objects, features, and advantages in accordance with the present invention are provided by a wireless communications device that includes a housing and wireless communications circuitry carried by the housing. The wireless communications device also includes an antenna assembly carried by the housing and coupled to the wireless communications circuitry, for example.

The antenna assembly includes a substrate, and a plurality of passive loop antennas carried by the substrate and arranged in side-by-side relation. Each of the plurality of passive loop antennas includes a passive loop conductor and a tuning element coupled thereto, for example.

The antenna assembly also includes an active loop antenna carried by the substrate and arranged to be at least partially coextensive with each of the plurality of passive loop antennas. The active loop antenna includes an active loop conductor and a pair of feedpoints defined therein, for example. Accordingly, the antenna assembly has a relatively reduced size, while maintaining performance, for example, by providing multi-band frequency operation, and providing increased gain with respect to area.

Each of the plurality of passive loop antennas may have a respective straight side adjacent each neighboring passive antenna. Each of the plurality of passive loop antennas may have a polygonal shape, for example. The polygonal shape may be one of a square shape, a hexagonal shape, and a triangular shape. Each of the plurality of passive loop antennas may have a same size and shape.

The active loop antenna may have a circular shape, for example. The plurality of passive loop antennas may define a center point. The active loop antenna may be concentric with the center point, for example.

Each of the tuning elements may include a capacitor, for example. The plurality of passive loop antennas may be positioned on a first side of the substrate and the active loop antenna is positioned on a second side of the substrate, for example. Each of the passive loop conductors and the active loop conductor comprises an insulated wire.

A method aspect is directed to a method of making an antenna assembly to be carried by a housing and to be coupled to wireless communications circuitry. The method includes positioning a plurality of passive loop antennas to be carried by a substrate in side-by-side relation. Each of the plurality of passive loop antennas includes a passive loop conductor and a tuning element coupled thereto, for example. The method also includes positioning an active loop antenna to be carried by the substrate and to be at least partially coextensive with each of the plurality of passive loop antennas. The active loop antenna includes an active loop conductor and a pair of feedpoints defined therein, for example.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple notation are used to indicate similar elements in alternative embodiments.

Figure 1:
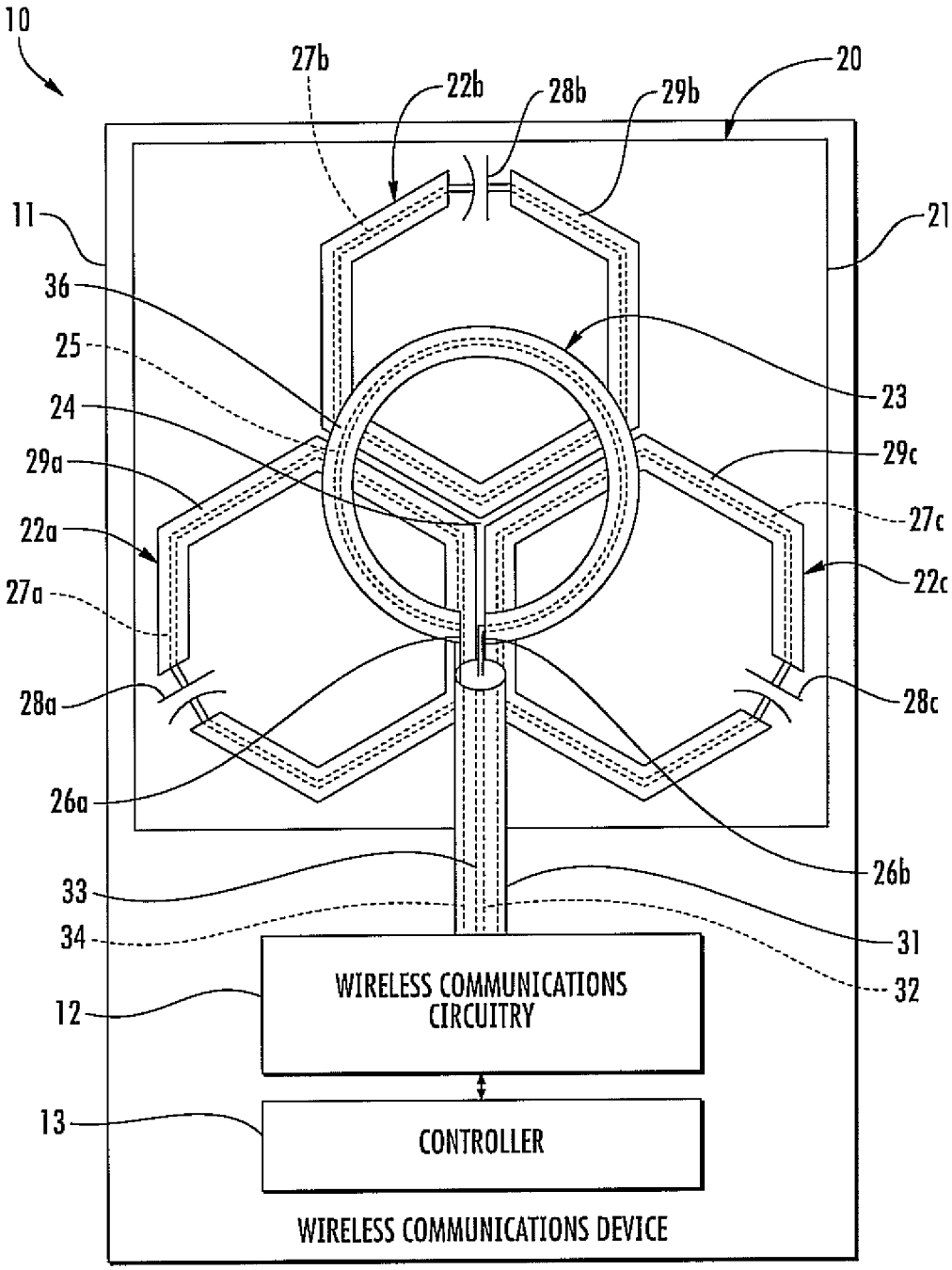
FIG. 1 is a schematic diagram of a mobile communications device including an antenna assembly in accordance with the present invention.

Referring initially to FIG. 1, a wireless communications device 10 includes a housing 11 and wireless communications circuitry 12 carried by the housing. The wireless communications circuitry 12 may be cellular communications circuitry or radiolocation tag circuitry, for example, and be configured to communicate voice and/or data. The wireless circuitry 12 may be configured to communicate over a plurality of frequency bands, for example, cellular, WiFi, and global positioning system (GPS) bands. Of course, the wireless communications circuitry 12 may be configured to communicate over other frequency bands. Other circuitry, for example, a controller 13 may be carried by the housing 11 and coupled to wireless communications circuitry 12. Additionally, the wireless communications device 10 may include an input device (not shown), for example, input keys and/or a microphone, and an output device (not shown), for example, a display and/or speaker, coupled to the controller 13 and/or wireless communications circuitry 12.

The wireless communications device 10 also includes an antenna assembly 20 carried by the housing 11 and coupled to the wireless communications circuitry 12. The antenna assembly 20 illustratively includes a substrate 21. The substrate 21 may be a printed circuit board substrate, for example, and may carry other components, as will be appreciated by those skilled in the art. The antenna assembly 20 also includes three same-sized hexagonal shaped passive loop antennas 22*a*-22*c* carried by the substrate 21. The passive loop antennas 22*a*-22*c* are arranged in a side-by-side relation. In the illustrated embodiment, each of the three passive loop antennas 22*a*-22*c* has a respective straight side adjacent each neighboring passive antenna. In a preferred embodiment, for example, the passive loop antennas 22*a*-22*c* each have a circumference of 0.5 wavelengths or less at the operating frequency, e.g. the passive radiating loop antennas are naturally resonant or electrically small relative to the wavelength.

As will be appreciated by those skilled in the art, each of the hexagonal passive loop antennas 22*a*-22*c* may be considered as an individual antenna element such that the combined electrical characteristics act like a loop antenna array. The hexagonal shape of the passive loop antennas 22*a*-22*c* creates a honeycomb lattice which advantageously provides an increased efficiency usage of space. The hexagonal tiling of space filling polyedra may be particularly advantageous in a portable wireless communications device where the housing 21 is relatively limited in size. The hexagonal shape of the passive loop antennas develop an increased radiation resistance at a reduced conductor loss for an increased efficiency gain and reduced overall size.

Each of the passive loop antennas 22*a*-22*c* includes a passive loop conductor 27*a*-27*c* and a tuning element 28 coupled thereto. As will be appreciated by those skilled in the art, the tuning element 28 determines the frequency band of a particular passive loop antenna 22, and not the size thereof. Instead, the size of each passive loop antenna 22 is related to the gain of the antenna assembly 20 at the frequency band corresponding to the respective passive loop antenna.

Each passive loop antenna 22 also includes a dielectric insulation layer 29 surrounding the passive loop conductor 27. In other words, each passive loop antenna 22 may be an insulated wire. The tuning element 28 is illustratively a capacitor and coupled inline with the passive loop conductor 27. Of course, the tuning element 28 may be another type of component, for example, an inductor, and may not be coupled inline, for example, a ferrite bead may instead surround the passive loop conductor 27 and the dielectric insulation layer 29. When the tuning element 28 is a capacitor, for example, the passive loop antennas 22*a*-22*c* become electrically loaded so that they operate at a smaller physical size and/or lower frequency. Thus, the tuning element 28, or capacitor, reduces the size.

As will be appreciated by those skilled in the art, the active loop antenna 23 cooperates with the passive loop antennas 22*a*-22*c* by inductive coupling such that the passive loop antennas act as three independent tunable antennas. Independent tuning of each of the passive loop antennas 22*a*-22*c* is accomplished by selecting or changing the value of each of the tuning elements 28, in particular, the capacitance.

The antenna assembly 20 also includes an active loop antenna 23 carried by the substrate 21. The active loop antenna 23 illustratively has a circular shape and is partially coextensive with each of the plurality of passive loop antennas 22*a*-22*c*. In other words, the areas of the active loop antenna 23 and passive loop antennas 22*a*-22*c* may overlap without touching one another. The active loop antenna includes an active loop conductor 25 and a pair of feedpoints 26*a*, 26*b* defined therein. The active loop antenna 23 may also include an insulation layer 36 surrounding the active loop conductor 25. In other words, the active loop antenna 23 may also be an insulated wire. The respective insulation layers advantageously provide dielectric spacing between the passive loop antennas 22*a*-22*c* and the active loop antenna 23 so that they do not short circuit.

Illustratively, the side-by-side relation of the passive loop antennas 22*a*-22*c* defines a center point 24, and the active loop antenna 23 is illustratively concentric with the center point. Of course, the active loop antenna 23 may not be concentric with the center point 24 in other embodiments. As will be appreciated by those skilled in the art, adjustment of an amount of offset may affect an amount of power coupled to each of the passive loop antennas 22*a*-220.

A feed conductor 31 or cable may couple the antenna assembly 20 to the wireless communications circuitry 12 via the feedpoints 26*a*, 26*b*. The feed conductor 31 may be coaxial cable, for example, and may include a center conductor 32 coupled to one of the feedpoints 26*a*, 26*b* and an outer conductor 34 coupled to the other of the feedpoints, and separated from the inner conductor by a dielectric layer 33. Other types of cables or conductors may be used, such as, for example, a twisted pair of insulated wire. In some instances, the feed cable 31 may itself become an antenna. Advantageously, the active loop antenna 23 may provide a balun to reduce the effect of the feed cable 31 inadvertently becoming an antenna. This is because the passive loop antennas 22*a*-22*c* do not have a direct current (DC) connection to the feed cable 31 (i.e. there is no conductive contact, but rather inductive coupling). The active loop antenna 23 may also function as balun or "isolation transformer" to reduce common mode currents on coaxial feedlines, for example.

Figure 2:
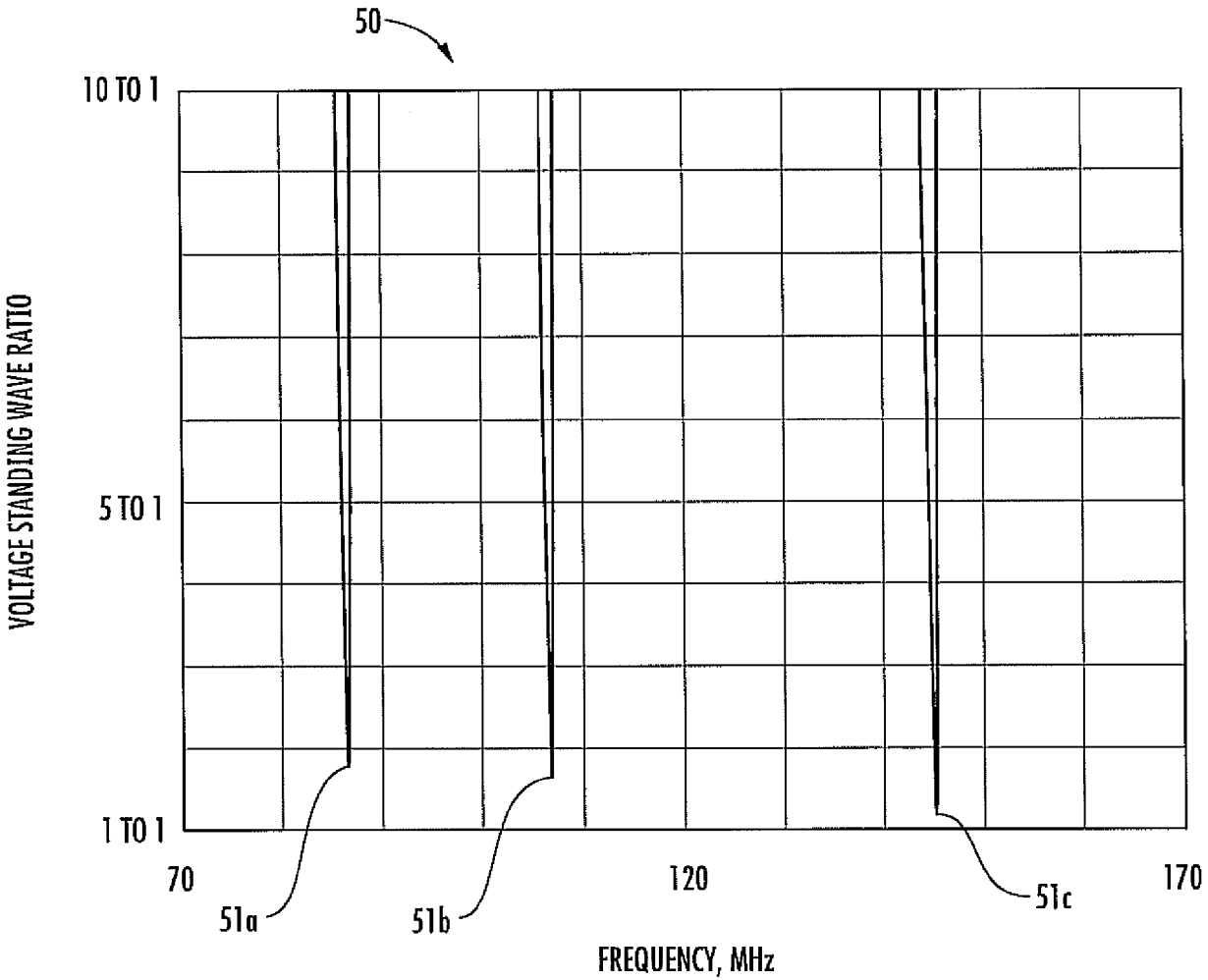
FIG. 2 is a graph of the measured frequency response of a prototype antenna assembly in accordance with the present invention.
Figure 3A:
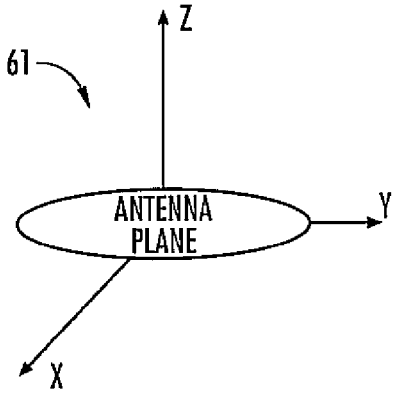
FIGS. 3*a*-3*d* are radiation pattern graphs for the antenna assembly of FIG. 1.
Figure 3B:
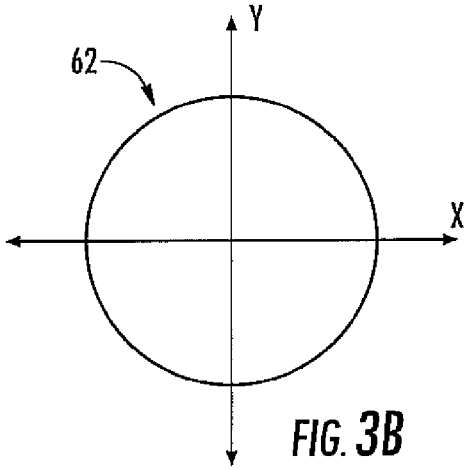
Figure 3C:
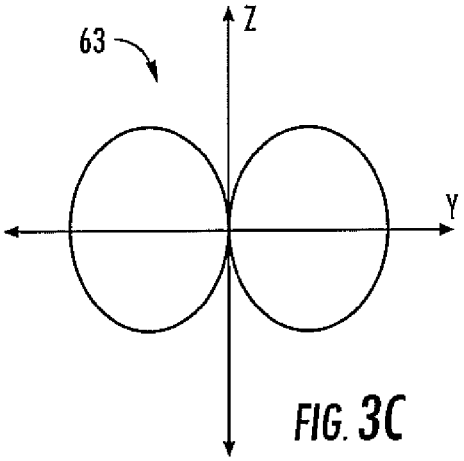
Figure 3D:
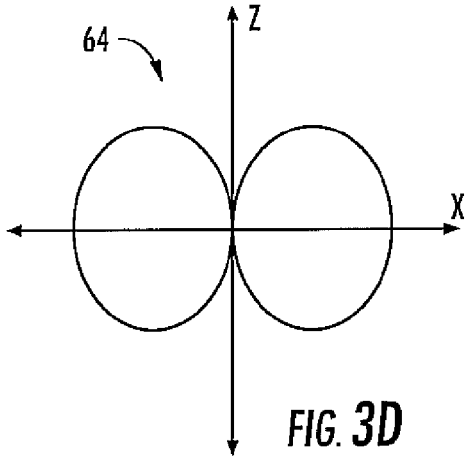

Referring now to FIG. 2, a graph 50 is shown of the measured frequency response, or voltage standing wave ratio, of a multiple band prototype antenna assembly similar to the antenna assembly 20 as illustrated in FIG. 1. The prototype antenna assembly included three hexagonal passive loop antennas and a circular active loop antenna. A first capacitor had a value of 30 picofarads, a second capacitor was 10 picofarads, and a third capacitor was 20 picofarads. Thus, each passive loop antenna loop had a different value tuning capacitor. The graph 50 illustratively includes three bands, 51*a*, 51*b*, 51*c* at about 86 MHz, 106 MHz, and 144 MHz respectively, that were independently realized based upon the values of the respective capacitors. A summary of the multiple band prototype is as follows:

Multiple Band Prototype Performance Summary

| Parameter | Value | Basis |
|---|---|---|
| Function | Three band antenna with single feedline | Specified |
| Spot Frequency Bands | Centered at 86, 106, 144 MHz | Measured |
| Number of passive loop antennas | Three (3) | Implemented |
| Shape of each passive loop antenna | Hexagonal | Implemented |
| Circumference of each passive loop antenna | 5.0 inches each (λ/27 at 86 MHz, λ/22 at 106 MHz, λ/16 at 144 MHz) | Measured |
| Shape of active loop antenna | Circular | Implemented |
| Circumference of active loop antenna | 5.84 inches | Measured |
| Location of active loop antenna | Approximately centered over the three radiating loop antennas. | |
| Passive loop antenna tuning capacitor | 30 picofarads, ceramic chip | Measured |
| Passive loop antenna tuning capacitor | 10 picofarads, ceramic chip | Measured |
| Passive loop antenna tuning capacitor | 20 picofarads, ceramic chip | Measured |
| Antenna construction | Thin loops of insulated solid copper wire | Implemented |
| Wire diameter | 0.020 inches | Nominal |
| Voltage Standing Wave Ratio | Less than 2.0 to 1 at each of the spot frequencies | Measured |
| Polarization | Linear horizontal | Measured |
| Passband response | A three band antenna was realized, e.g. three separate quadratic responses | Observed by measurement |

Individual electrically small antennas, for example, may have a quadratic frequency response. Thus, such antennas may cover a single frequency band that may be relatively narrow. The antenna assembly 20, however, may be tuned so that each of the three frequency bands may be combined to form single enlarged or broad frequency band with respect to each frequency band individually. More particularly, the resonance of each hexagonal shaped passive loop antenna 22*a*-22*c* may be adjusted according to the Chebyschev polynomial to provide an increased bandwidth to a specified ripple. For example, each of the passive loop antennas may be stagger tuned to the zeroes of the nth order Chebyshev polynomial. For example, two passive loop antennas can provide a $4^{th}$ order Chebyschev response with 2 ripple peaks and about 4 times the bandwidth of a single passive loop antenna.

More particularly, for example, an antenna assembly having a single hexagonal shaped passive loop antenna has a quadratic response according to $ax^2+bx+c=0$. For example, if the single hexagonal shaped passive loop antenna has a diameter of 0.12λ, the 6:1 voltage standing wave ratio (VSWR) bandwidth is about 1.52%. An antenna assembly according to the present invention, having, for example, two hexagonal shaped passive loop antennas has a Chebyshev polynomial response according to:

$$\Sigma=T_n(x)t^n=(1-tx)/(1-2tx+t^2)$$

Where:

$T_n$=Chebyschev polynomial of degree n x=angular frequency=2πf

Thus, if each hexagonal shaped passive loop antenna also has a diameter of 0.12λ, the bandwidth is about 4×1.52% or 6.1%. The ripple frequency of the Chebyschev polynomial generally increases with the order n so when ripple amplitude is held constant, a diminishing return occurs with increasing order n. An infinite number of passive loop antennas, for example, may provide up to 3π more instantaneous bandwidth than a single radiating loop antenna, as will be appreciated by those skilled in the art. Testing has shown that two passive loop antennas provide four times the bandwidth of a single passive loop antenna. Thus, the embodiments advantageously provide a loop antenna array with versatile tunings for reduced size and increased instantaneous bandwidth. The embodiments advantageously provide the versatile tunings through radiating structures rather than external lumped element networks of passive components, for example, without a ladder network of inductors and/or capacitors. Referring now to the graphs 61, 62, 63, 64, 65 in FIGS. 3*a*-3*d*, and 4, the radiation pattern of the antenna assembly 20 is generally toroidal. The graph 61 illustrates the plane of the antenna assembly 20 in a Cartesian coordinate system. As will be appreciated by those skilled in the art, the plane of the antenna assembly 20 lies in the XY plane. The graph 62 illustrates that the XY plane radiation pattern cut of the antenna assembly 20 is circular and omnidirectional.

Similarly, the graphs 63, 64, respectively illustrate that the shape of the radiation pattern cuts in the YZ and ZX planes are that of a two petal rose having the function $\cos^2\theta$. The radiation pattern is a Fourier transform of the current distribution around the loop which is uniform at smaller loop sizes. The antenna assembly 20 radiation pattern shape is similar to a canonical ½ wave wire dipole oriented along the graph 61 Z axis, although the ½ wave dipole will be vertically polarized and the antenna assembly 20 will be horizontally polarized. Horizontal polarization may be particularly advantageous to aid in long range propagation by tropospheric refraction, for example. Moreover, the antenna assembly 20 has radiation pattern nulls broadside the antenna plane, and the radiation pattern lobe is in the antenna plane. The half power beamwidth of the antenna assembly 20 in the YZ and ZX pattern cuts is about 82 degrees. The directivity is 1.5. When mismatch loss is zero, for example, the realized gain and radiating pattern, as will be appreciated by those skilled in the art, may be calculated according to:

$$\text{Realized Gain}=10\log_{10}(\eta D\cos^2\theta)$$

Where:

η=the radiation efficiency of the antenna assembly 20

D=the antenna directivity=1.5 for the antenna assembly 20

Θ=the elevation angle measured from normal to the plane of the antenna assembly 20. (θ=0° normal to the antenna plane and θ=90° in the antenna assembly plane)

In practice, with relatively low loss tuning capacitors, the radiation efficiency η is mostly a function of the passive loop antenna 22*a*-22*c* radiation resistance $R_r$ relative the passive loop antennas conductor loss resistance $R_l$ so the radiation efficiency may be calculated as:

$$\text{Radiation Efficiency } \eta=R_R/(R_r+R_l)$$

and the realized gain as:

$$\text{Realized Gain}=1.76-10\log_{10}(R_r/(R_r+R_l))\text{ dBil}$$

Figure 4:
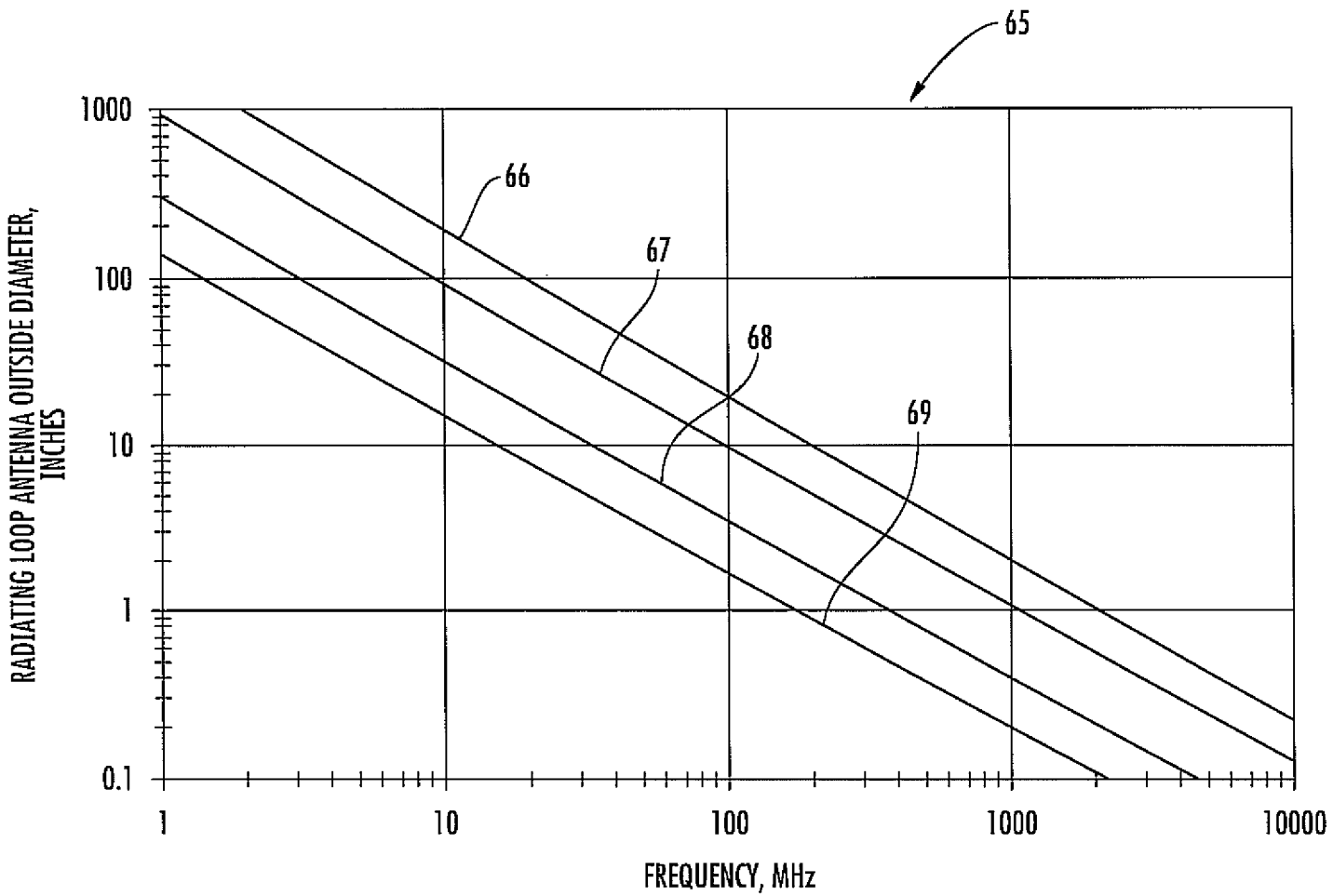
FIG. 4 is a graph illustrating the relationship between size and frequency for a hexagonal passive loop antenna in accordance with the present invention.

The graph 65 in FIG. 4 illustrates the typical relationship (calculated) between size, realized gain, and frequency for a single hexagonal passive loop antenna. The graph 65 in FIG. 4 also illustrates the typical realized gain provided by an embodiment of the antenna assembly. The antenna assembly corresponding to the graph 65 is a single passive loop antenna similar to the antenna assembly 20 in FIG. 1, and is copper and greater than 3 RF skin depths thick. The antenna assembly is tuned and matched, by using radiation pattern peak gain, for example, and the polarization is co-polarized. The tuning element is a capacitor having quality factor Q=1000, and the passive loop antenna trace width is about 0.15 inches at the passive loop antenna outer diameter. Illustratively, the lines 66, 67, 68, and 69 correspond to +1.5, 0.0, −10.0, and −20.0 dBil realized gain, respectively. As will be appreciated by those skilled in the art, the embodiments advantageously allowing tradeoffs between antenna size and realized gain and provide increased efficiency with respect to size.

In a test of a prototype antenna assembly similar to the antenna assembly 20 of FIG. 1, the antenna assembly was used for radiolocation purposes using Global Positioning System (GPS) satellites. The antenna assembly provided relatively high GPS satellite constellation availability so many satellites could be received at once. A performance summary for the prototype antenna assembly GPS reception is a follows:

GPS Prototype Performance Summary

| Parameter | Value/Function | Basis |
|---|---|---|
| Function | Receive antenna for the Global Positioning System (GPS) L1 signal | Specified |
| Wireless communications circuitry | Battery powered, radiolocation tag | Implemented |
| Center Frequency | GPS L1 at 1575.2 MHz | Measured |
| Antenna assembly size | Circular disc, 0.900 inches diameter, 0.011 inches thick | Measured |
| Number of passive loop antennas | One (1) | Implemented |
| Outer diameter of passive loop antenna | 0.900 inches (0.12λ) | Measured |
| Outer diameter of active loop antenna | 0.306 inches | Measured |
| PWB Material | 0.010 inch thick G10 epoxy glass with ½ ounce copper conductors | Specified |
| Copper trace thickness | 0.0007 inches | Nominal |

-continued

| GPS Prototype Performance Summary | | |
|---|---|---|
| Parameter | Value/Function | Basis |
| Passive loop antenna trace width | 0.19 inches | Measured |
| Active loop antenna trace width | 0.020 inches | Measured |
| Realized Gain | +1.0 dBil | Measured in anechoic chamber |
| Realized Gain | +1.1 dBil | Calculated |
| Antenna radiation efficiency | 84% | Calculated from measured gain |
| Passive loop antenna radiation resistance | 1.47 ohms | Calculated |
| Passive loop antenna copper loss Resistance | 0.063 ohms | Calculated |
| Passive loop antenna inductance | 0.021 microhenries | Calculated |
| Tuning capacitor (tuning element) | 0.48 picofarads total, realized from a 0.40 picofarad ceramic chip capacitor and an ablatable trimmer | Measured |
| Reactance of tuning capacitor | −211 j ohms | Calculated |
| Q of tuning capacitor | 1100 | Manufacturers specification |
| Equivalent series loss resistance of tuning capacitor | 0.19 ohms | Calculated from manufacturers specification |
| Voltage Standing Wave Ratio | 1.2 to 1 in a 50 ohm system | Measured |
| Polarization | Linear horizontal when the antenna plane was horizontal | Measured |
| Passband response shape | Quadratic (single gain peak) | Observed in swept gain measurement |
| Instantaneous 3 dB gain bandwidth | 24 MHz or 1.5% | Measured in anechoic chamber |
| Antenna Q | 131 | Calculated from measured gain bandwidth measurement |
| Chu's single mode limit bandwidth for a 0.9 inch diameter spherical envelope | 10.6% | Calculated |
| Antenna assembly realized percentage of the Chu's single mode limit bandwidth | 14.1% | Calculated |

The GPS prototype had the operative advantage of reduced deep cross sense circular polarization fades. Right hand circularly polarized microstrip patch antennas tend to become left hand circularly polarized when inverted, which can produce deep fades in GPS reception. Thus, when wireless communications circuitry includes a GPS radiolocation tag, for example, with an antenna assembly, the antenna assembly provided increased reliability reception than a microstrip patch antenna having circular polarization and higher gain, for example. In GPS radiolocation devices, the antenna is generally un-aimed and unoriented. Indeed, in the present embodiment, when the circumference of the passive loop antenna approaches ½ wavelength, the radiation pattern becomes nearly spherical and isotropic.

Figure 5:
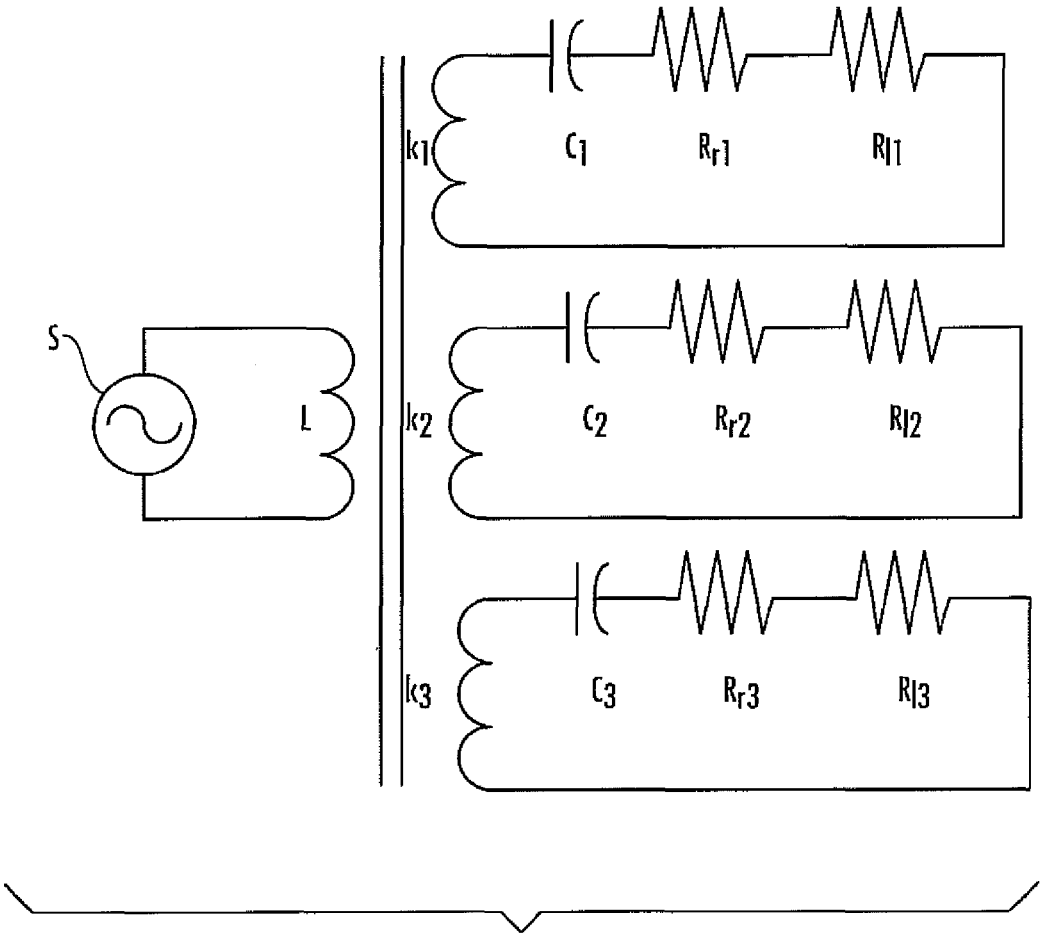
FIG. 5 is a schematic diagram of a circuit equivalent of the antenna assembly in FIG. 1.

Referring now additionally to FIG. 5, the circuit equivalent model of the antenna assembly 20 may be regarded as a transformer with multiple secondary windings, so that a power divider is realized, for example. The signal generator S corresponds to the wireless communications circuitry 12. As will be appreciated by those skilled in the art, the active loop antenna 23 corresponds to a primary winding L, while the three hexagonal passive loop antennas 22*a*-22*c* correspond to respective secondaries $k_1$, $k_2$, $k_3$. Power may be equally divided three-ways, by the active loop antenna 23 being concentric with the center point 24 defined by the three hexagonal passive loop antennas 22*a*-22*c*. Adjustment of the amount of coextension of the three hexagonal passive loop antennas 22*a*-22*c* over the active loop antenna 23 is equivalent to adjustment of the "turns ratio" of conventional transformers having multiple turn windings.

In the illustrated corresponding circuit schematic diagram, the equivalent tuning elements are the capacitors $C_1$, $C_2$, $C_3$. The illustrated resistors $R_{r1}$, $R_{r2}$, $R_{r3}$, correspond to the radiation resistance. In other words, this is the resistance provided by the conductor itself, for example, a copper conductor. $R_{11}$, $R_{12}$, $R_{13}$ correspond to conductor resistance loss from joule effect heating. As will be appreciated by those skilled in the art, if the antenna assembly 20 is too small, $R_1$ increases, and performance may decrease to a potentially unacceptable level. $R_1$ is usually the predominant determinant of the antenna efficiency. In fact, tuning capacitor equivalent series resistance (ESR) losses often may be neglected. The radiation efficiency η of an individual passive loop antenna can be therefore be approximately by:

$$\eta = R_{r1}/(R_{l1}+R_{r1})$$

and the realized gain approximated by:

$$G = 10 \log_{10} \{1.5[R_{r1}/(R_{l1}+R_{r1})]\} \text{ dBil.}$$

As background, the loss resistance of metal conductors is generally a fundamental limitation to efficiency and gain of room temperature electrically small antennas. When electrically small, the directivity of an individual passive loop antenna is 1.76 dB. This value of directivity does not significantly increase or decrease with the number or passive loop antennas. In typical practice, the active loop antenna may be adjusted to provide 50 ohms of resistance, and the metal conductor loss of the active loop may be neglected.

The passive loop antennas typically do not significantly couple to one another when their loop structures do not overlap, e.g. the mutual coupling is less than about −15 dB in those circumstances. Overlapping of the passive loop antennas may alter the mutual coupling as desired. The degree of mutual coupling adjusts the spacing between the Chebyschev responses. Thus, the features of the present embodiments allow for control of driving resistance (active loop diameter), reactance (tuning capacitor), frequency (tuning element value), element mutual coupling (spacing between passive loop antennas, size (tuning element provides loading), gain (passive loop antenna diameter), and bandwidth (the number of passive loop antennas 22 adjust the frequency response ripple).

Figure 6:
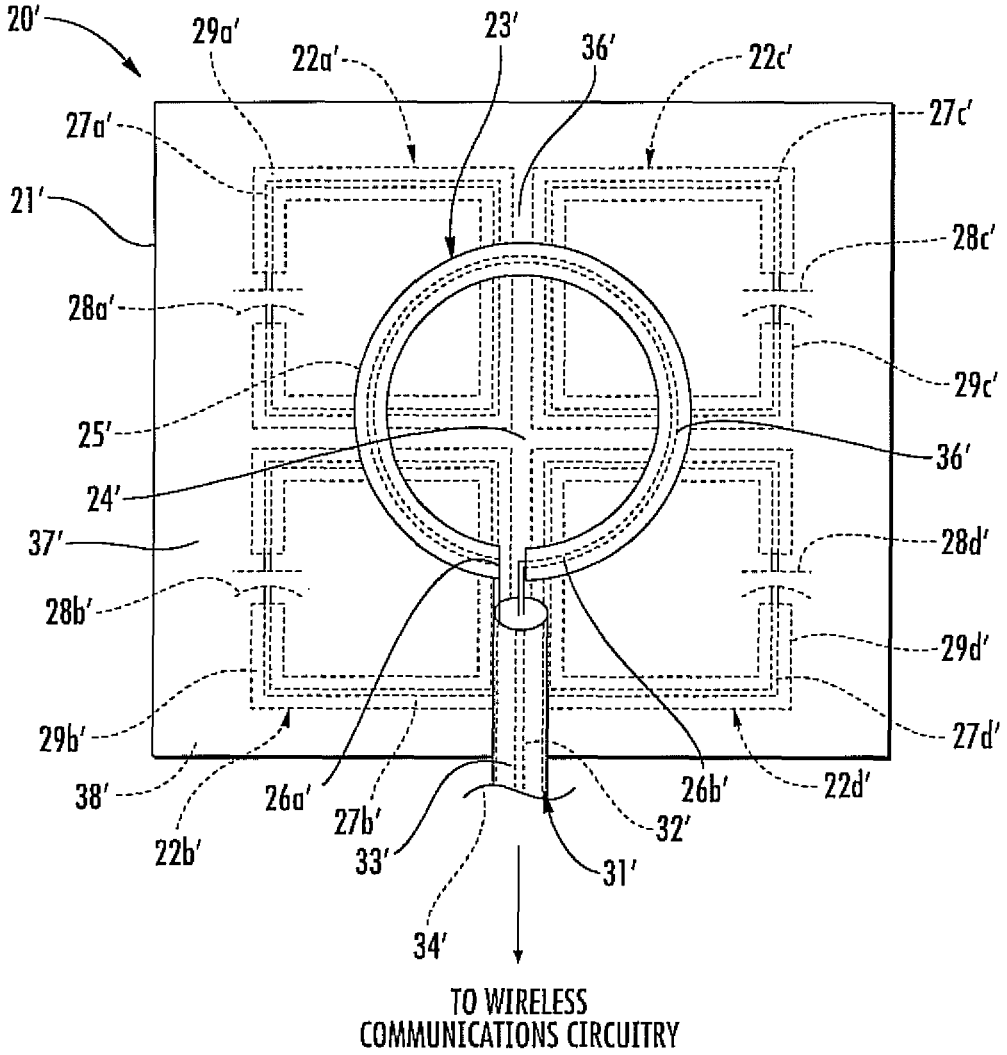
FIG. 6 is schematic diagram of another embodiment of an antenna assembly in accordance with the present invention.

Referring now to FIG. 6, another embodiment of an antenna assembly 20' illustratively includes four passive loop antennas 22*a*'-22*d*' each having a square shape and carried by a first side 37' of the substrate 21'. The four passive loop antennas 22*a*'-22*d*' are illustratively arranged in side-by-side relation and define a center point 24' corresponding to a corner of each of the square passive loop antennas. The active loop antenna 23', which is carried on a second side 38' of the substrate 21', or opposite side from the passive loop antennas 22', is partially coextensive with each of the four square shaped passive loop antennas 22a'-22d'. Each of the four square passive loop antennas 22a'-22d' includes a respective tuning member 28a'-28d', or capacitor coupled to respective passive loop conductors 27a'-27d'. As will be appreciated by those skilled in the art, each of the four passive loop antennas 22a'-22d' corresponds to a frequency band that is determined by respective capacitors 28a'-28d'.

Figure 7:
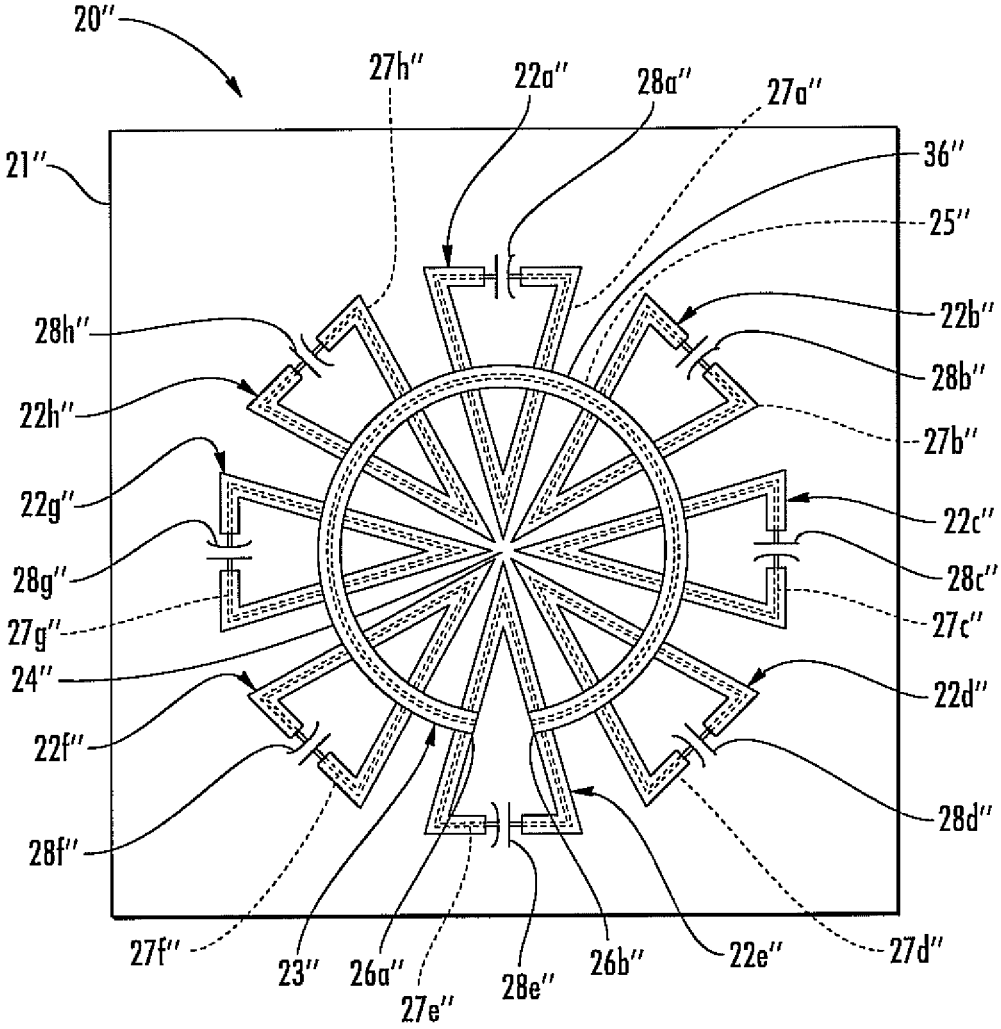
FIG. 7 is a schematic diagram of yet another embodiment of an antenna assembly in accordance with the present invention.

Referring now to FIG. 7, yet another embodiment of the antenna assembly 20" illustratively includes eight passive loop antennas 22a"-22h" each having a triangular or pie shape. The eight passive loop antennas 22a"-22h" are illustratively arranged in side-by-side relation and define a center point 24" corresponding to a point of each of the triangular passive loop antennas. The active loop antenna 23" is partially coextensive with each of the eight triangular shaped passive loop antennas 22a"-22h". Each of the eight triangular passive loop antennas 22a"-22" includes a respective tuning member 28a'-28d', or capacitor, coupled to respective passive loop conductors 27a"-27h". As will be appreciated by those skilled in the art, each of the eight passive loop antennas 27a"-27h" corresponds to a frequency band that is determined by respective capacitors 28a"-28h".

While each passive loop antenna 22 described herein is illustratively a same size shape, the passive loop antennas may have any polygonal shape. Additionally, in some embodiments, each of the passive loop antennas 22 may not be the same size.

A method aspect is directed to a method of making an antenna assembly 20 to be carried by a housing 11 and to be coupled to wireless communications circuitry 12. The method includes positioning a plurality of passive loop antennas 22 to be carried by a substrate 21 in side-by-side relation. Each of the passive loop antennas 22 include a passive loop conductor 27 and a tuning element 28 coupled thereto. The method also includes positioning an active loop antenna 23 to be carried by the substrate 21 and to be at least partially coextensive with each of the passive loop antennas 22. The active loop antenna 23 includes an active loop conductor 25 and a pair of feedpoints 26a, 26b, defined therein.

Figure 8:
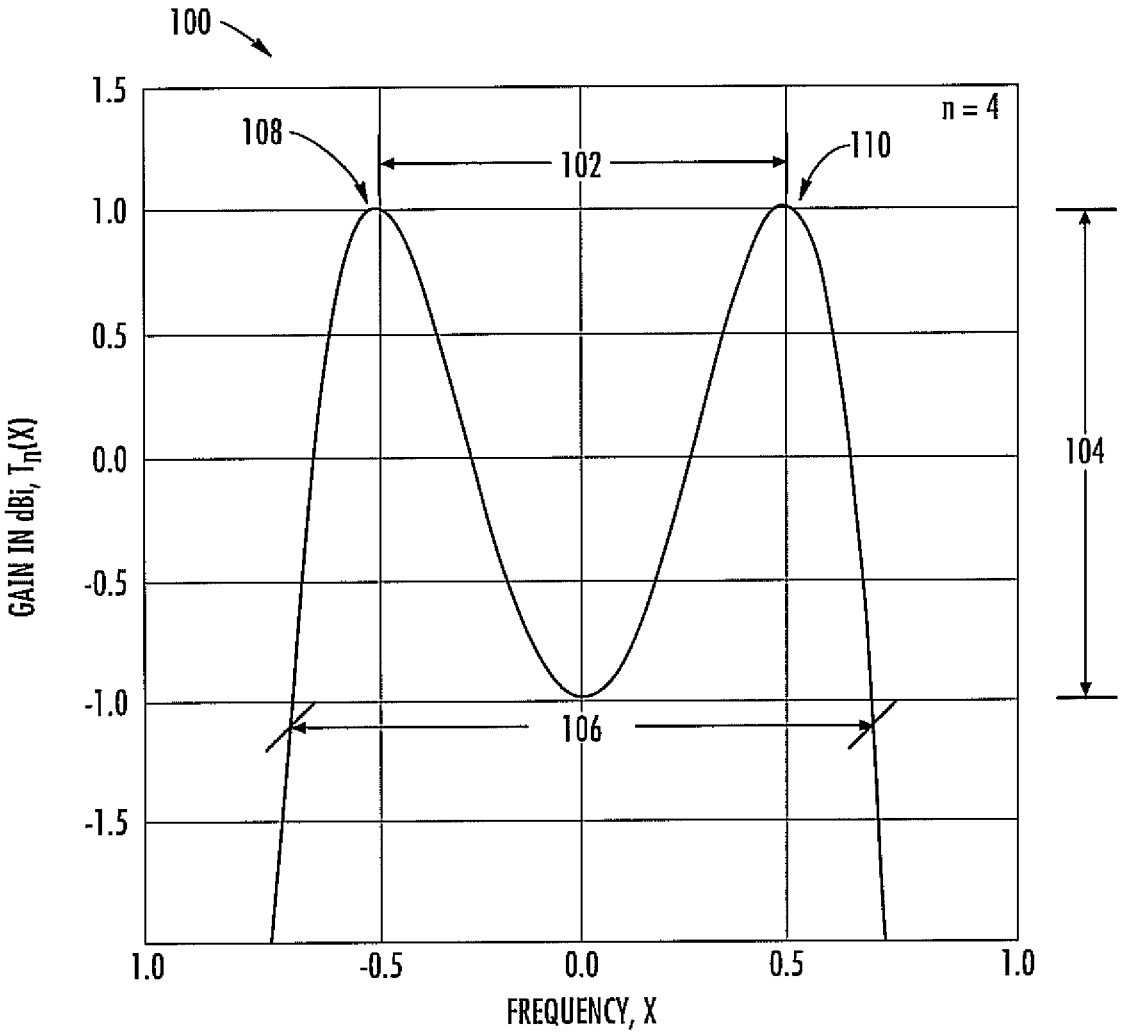
FIG. 8 is a graph of gain response versus frequency for a Chebyschev embodiment of an antenna assembly in accordance with the present invention.

Referring now to the graph 100 in FIG. 8, the gain response of a double tuned/$4^{th}$ order Chebyschev embodiment of the antenna assembly is illustrated. Illustratively, there is a rippled passband 106 with two gain peaks, but the two peaks of passband are considered as being a single continuous passband, e.g. so a single band antenna with ripple is formed. Ripple in the passband 106 may be particularly beneficial to provide increased bandwidth, for example. The antenna assembly corresponding to the graph 100 includes two (2) passive loop antennas are adjacent each other with one (1) active loop antenna overlapping each passive loop antenna. To realize the double tuned $4^{th}$ order Chebyschev polynomial response, the radiating loop antennas are preferentially of equal size, and they use similar or identical value tuning element capacitors. Thus, the individual resonant frequencies of the passive loop antennas are the same by themselves. However, when the passive loop antennas are brought relatively close to each other, mutual coupling may cause the two gain peaks 106, 108 in the frequency response to form. The quadratic responses of two individual passive loop antennas thus combine to become a double tuned $4^{th}$ order Chebyschev response.

The ripple amplitude 104 and the bandwidth 106 may be adjusted by adjusting the spacing of the passive loop antennas with respect to each other. When the two passive loop antennas are further apart, the spacing between gain peaks 102 is reduced and so the bandwidth 106?? is reduced, and the ripple level amplitude 104 is reduced.

When the spacing between the two passive loop antennas are closer, the spacing 102 between the gain peaks 108, 110 is increased (the responses spread apart), so the bandwidth 106 is increased, and the ripple amplitude 104 is increased. The two passive loop antennas may even overlap each other (but not touch each other) to create relatively very large bandwidths. As can be appreciated, the double tuned $4^{th}$ order Chebyschev embodiment advantageously provides a wide and continuous range of tradeoff between ripple level 104 and bandwidth 106.

In the double tuned $4^{th}$ order Chebyschev embodiment using two passive loop antennas, the diameter of the active loop antenna adjusts the circuit resistance that the antenna provides to the wireless communications circuitry. A larger diameter active loop increases the resistance provided to the transmitter, and a smaller diameter active loop reduces the resistance provided to the transmitter. 50 ohms resistance has been readily achievable in practice when the diameter of the active loop was about 0.2 to 0.5 the diameter of a passive loop antennas. The size of the active loop antenna may be adjusted to obtain active and 1 to 1 VSWR. Alternatively, the active loop antenna may be increased in size to provide an overactive trade for increased bandwidth with increased VSWR at the two gain peaks 108, 110.

The active loop antenna advantageously provides a resistance compensation over a given frequency. In other words, as the passive loop antennas become smaller, their radiation resistance drops, but the coupling factor of the active loop antenna increases as the passive loop antennas become smaller. Thus, the desired resistance seen by the electronics circuitry may be constant over a relatively broad bandwidth. The compensation behavior is thought to be due to the transition in the passive loop antennas' current distribution from sinusoidal to uniform with reduced passive loop antenna circumference. Loop antennas have stronger magnetic near fields when electrically small so they become better transformer secondaries. The passive loop antenna is a far field antenna for radiation, and also a near field antenna.

Highest gain results when the electrical conductor forming the passive loop antennas have a width near 0.15 that of the loop outer diameter. Thus, if a passive loop antenna has an outside diameter of 1.0 inch, and each passive loop antenna is wire, the highest realized gain typically occur when the wire diameter is 0.15 inches. If the passive loop antenna is 1 inch in diameter and formed as a printed wiring board (PWB) trace, the width of that trace should be also about 0.15 inches for increased radiation efficiency. Of course other conductor widths can be used if desired.

The conductor loss resistance is increased when the trace width is too small as there is too little metal to conduct efficiently. Yet, when the trace width is too large, proximity effect increases the conductor loss resistance. When conductor proximity effect occurs, the current hugs the inside edge of the loop conductor and not all the metal is put used for radiating. The loop conductor on the opposite side of the loop causes the proximity effect. The hole in the loop should generally be sized appropriately. The optimal loop conductor trace width for the passive loop antennas was verified by experiment.

Figure 9:
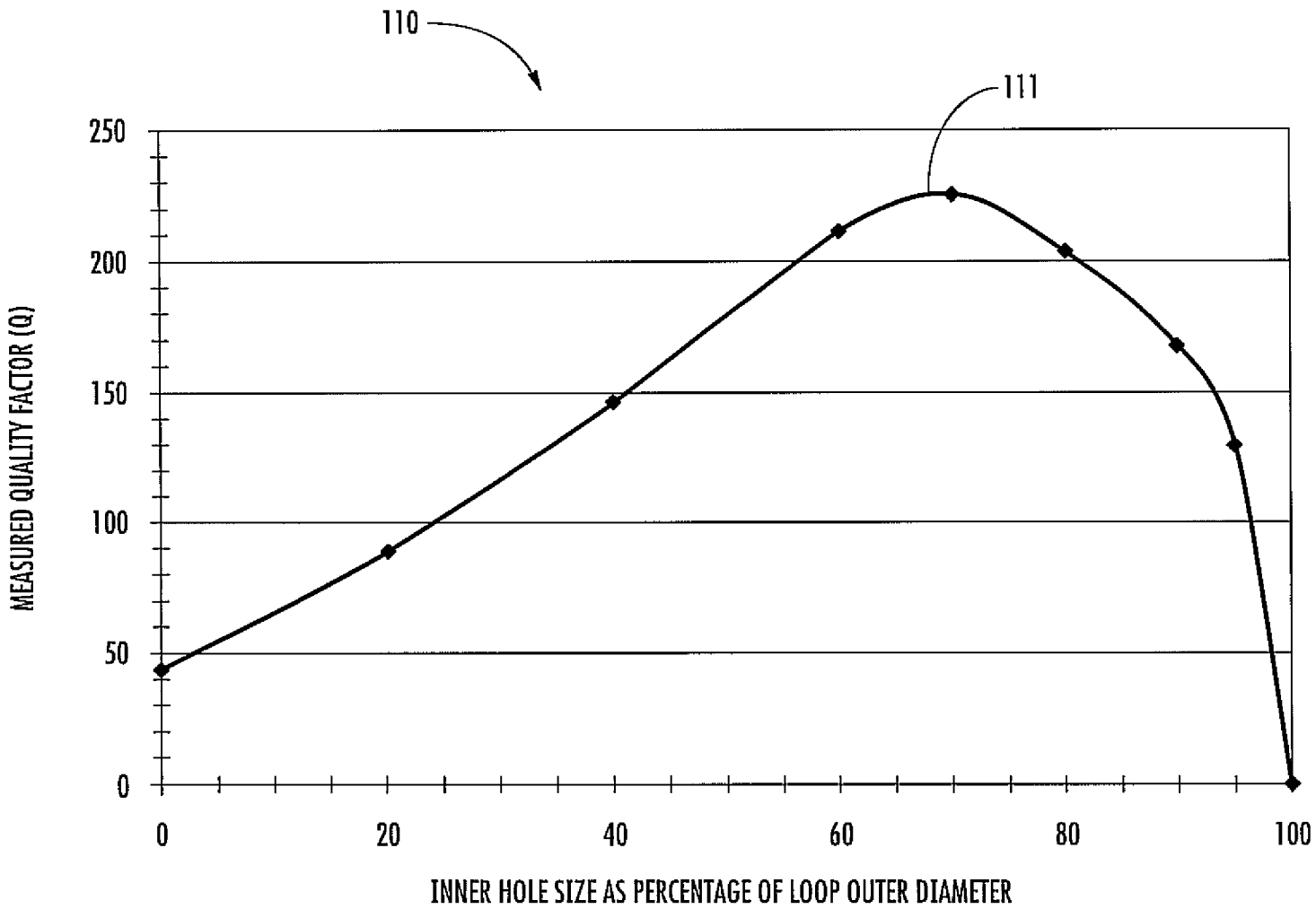
FIG. 9 is a graph of measured quality factor for an antenna assembly in accordance with the present invention.

The graph 110 of FIG. 9 illustrates the measured quality factor (Q) 111 of a PWB embodiment single passive loop antenna versus loop conductor trace width. Q is an indication of antenna gain so when the Q is highest the realized antenna gain is highest. The outer loop diameter was 1.0 inch and it was operated at 146.52 MHz so the outer loop diameter was λ/84. Thus, critical active and resonance at 146.52 MHz was considered and adjusted. The thickness of the PWB copper traces was greater than 3 skin depths thick. When the loop antenna hole was 90 percent of the outer diameter, a 22 picofarad capacitor was connected across a gap in the loop to cause set the resonance at 146.52 MHz. When the passive loop antenna internal hole size was zero, the antenna was effectively a notched metal disc. It used a 290 picofarad chip capacitor across the notch at the disc rim, and the resonance was again at 146.52 MHz. As illustrated from the graph 110 in FIG. 9 the best measured Q 111 was 225, and this occurred when the diameter of the inner hole was 70 percent that of the loop outer diameter. The loop outer diameter was 1.0 inches, and the loop inner diameter equaled 0.7 inches at highest Q and realized gain. The trace width for the best realized gain was therefore (1.0–0.7)/2=0.15 the loop outer diameter.

The active loop antenna 23 typically does not radiate appreciably or have significant ohmic losses. As background, the active loop antenna 23 also provides a balun of the isolation transformer type.

Testing has shown that losses in G10 and FR4 type epoxy glass printed circuit board embodiments of the antenna assembly 20 have been negligible at UHF, e.g. at frequencies between 300 MHz and 3000 MHz. Thus, most commercial circuit materials are generally suitable for the substrate 21. The antenna assembly 20 accomplishes this operative advantage by having stronger radial magnetic near fields rather than radial electric near fields which minimizes PWB dielectric losses. Additionally, the antenna assembly 20 tuning and loading is accomplished by component capacitors rather than the PWB dielectric. For example, chip capacitors are relatively inexpensive and low loss, and the NPO variety has relatively flat temperature coefficients. Stable capacitance over temperature means that the antenna assembly 20 can have relatively stable frequency of operation over temperature. This can be an advantage of the antenna assembly 20 over typical microstrip patch antennas, for example.

As background, microstrip patch antennas may require costly, low loss controlled permittivity materials as the antenna "patch" forms a printed circuit transmission line concentrating electric near fields in the PWB dialectic. The capacitance of microstrip patch antenna PWB materials is generally not as stable over temperature as are NPO chip capacitors. Thus antenna 20 may have stable tuning along and may be planar and relatively easy to construct at a relatively low expense.

The present embodiments advantageously provide multiband operation and/or to provide relatively broad single band bandwidth with a Chebyschev passband response. However, embodiments of the antenna assembly also provide broad tunable bandwidth. Variable tuning over a wide range is accomplished by varying the reactance of a tuning element 28, for example. Thus, the tuning element 28 may be a variable capacitor, for example. The tunable bandwidth can be over a 7 to 1 frequency range with a relatively low voltage standing wave ratio (VSWR). In an HF prototype, a VSWR under 2 to 1 was realized across a continuous 3 to 22 MHz tuning range using a vacuum variable capacitor having a range of 10 to 1000 picofarads, and the passive loop antenna 22 was formed from a hexagon of copper water pipe having a circumference of 18 feet. The change in the antenna operating frequency is the square root of the reactance change in tuning element 28, such that, for example, to double the operating frequency the tuning element the capacitor value is reduced to $\frac{1}{2}^2=\frac{1}{4}$ of original value. The tuning element 28 may be a varactor diode for electronic tuning, for example. The desired value of the tuning element 28 may be calculated from the common resonance formula $\frac{1}{2}\pi\sqrt{LC}$ once the inductance of the passive loop antenna 22 is known. The inductance of the passive loop antenna 22 can be measured or calculated using the formula:

$$L \text{ in micro-henries}=0.01595[2.303\ \mathrm{Log}_{10}(8D/d-2)]$$

Where:

D=the mean diameter of the passive loop antenna d=the diameter of the wire conductor Increasing the capacitance of the tuning element 28 lowers the operating frequency of the antenna assembly 20, and decreasing the capacitance raises the frequency. In most circumstances it is preferential to use a capacitor as the tuning element 28 for reduced losses, although an inductor may be used if desired. An example and application for the antenna assembly 20 is for television and FM broadcast reception with extended range. Typical broadcasts in these frequency bands include horizontal polarization components, and the antenna assembly 20 advantageously responds to horizontal polarization components when oriented in the horizontal plane. Horizontal polarization is known to propagate over the horizon by tropospheric refraction. Thus, the antenna assembly 20 may provide greater range than a vertical ½ wave dipole. The antenna assembly 20 is omni-directional when horizontally polarized, aiming may not be desired. A passive loop antenna **22*a*-22*c*** can render +1.0 dBil realized gain at 100 MHz when it is 19 inches in diameter, and thus may be used indoors.

Although there are many differences between loop antennas and dipole antennas, electrically small dipole antennas and loop antennas are typically loaded to smaller size with capacitors and inductors respectively. In the current art, and at room temperature, there are better insulators than conductors, so the efficiency and Q of capacitors is usually much better than inductors. Indeed, the quality factor of capacitors is typically 10 to 100 times better than inductors. Thus, loop antennas similar to the present embodiments of the antenna assembly may be preferred over dipole antennas as they may accomplish size reduction, loading, and tuning using relatively low loss and relatively inexpensive capacitors. Loop antennas also provide an inductor and a transformer winding with limited or reduced additional components. Thus, the present embodiments provide a compound design in which the antenna inductor, matching transformer, and balun are integrated into the antenna structure.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A wireless communications device comprising:

a housing;

wireless communications circuitry carried by said housing; and an antenna assembly carried by said housing and coupled to said wireless communications circuitry and comprising a substrate, a plurality of passive loop antennas carried by said substrate and arranged in side-by-side relation, each of said plurality of passive loop antennas comprising a passive loop conductor and a tuning element coupled thereto, and an active loop antenna carried by said substrate and arranged to be at least partially coextensive with each of said plurality of passive loop antennas, said active loop antenna comprising an active loop conductor and a pair of feedpoints defined therein.

2. The wireless communications device according to claim 1, wherein each of said plurality of passive loop antennas has a respective straight side adjacent each neighboring passive antenna.

3. The wireless communications device according to claim 1, wherein each of said plurality of passive loop antennas has a polygonal shape.

4. The wireless communications device according to claim 3, wherein the polygonal shape is one of a square shape, a hexagonal shape, and a triangular shape.

5. The wireless communications device according to claim 1, wherein each of said plurality of passive antennas has a same size and shape.

6. The wireless communications device according to claim 1, wherein said active loop antenna has a circular shape.

7. The wireless communications device according to claim 1, wherein said plurality of passive loop antennas define a center point; and wherein said active loop antenna is concentric with the center point.

8. The wireless communications device according to claim 1, wherein each of said tuning elements comprises a capacitor.

9. The wireless communications device according to claim 1, wherein said plurality of passive loop antennas are positioned on a first side of said substrate and said active loop antenna is positioned on a second side of said substrate.

10. The wireless communications device according to claim 1, wherein each of said passive loop conductors and said active loop conductor comprises an insulated wire.

11. An antenna assembly comprising:

a substrate;

a plurality of passive loop antennas carried by said substrate and arranged in side-by-side relation, each of said plurality of passive loop antennas comprising a passive loop conductor and a tuning element coupled thereto; and an active loop antenna carried by said substrate and arranged to be at least partially coextensive with each of said plurality of passive loop antennas, said active loop antenna comprising an active loop conductor and a pair of feedpoints defined therein.

12. The antenna assembly according to claim 11, wherein each of said plurality of passive loop antennas has a respective straight side adjacent each neighboring passive antenna.

13. The antenna assembly according to claim 11, wherein each of said plurality of passive loop antennas has a polygonal shape.

14. The antenna assembly according to claim 11, wherein each of said plurality of passive loop antennas has a same size and shape.

15. The antenna assembly according to claim 11, wherein said active loop antenna has a circular shape.

16. The antenna assembly according to claim 11, wherein said plurality of passive loop antennas define a center point; and wherein said active loop antenna is concentric with the center point.

17. The antenna assembly according to claim 11, wherein each of said tuning elements comprises a capacitor.

18. A method of making an antenna assembly to be carried by a housing and to be coupled to wireless communications circuitry, the method comprising:

positioning a plurality of passive loop antennas to be carried by a substrate in side-by-side relation, each of the plurality of passive loop antennas comprising a passive loop conductor and a tuning element coupled thereto; and positioning an active loop antenna to be carried by the substrate and to be at least partially coextensive with each of the plurality of passive loop antennas, the active loop antenna comprising an active loop conductor and a pair of feedpoints defined therein.

19. The method according to claim 18, wherein positioning the plurality of passive loop antennas comprises positioning each of the plurality of passive loop antennas to have a respective straight side adjacent each neighboring passive antenna.

20. The method according to claim 18, wherein each of the plurality of passive loop antennas has a polygonal shape.

21. The method according to claim 18, wherein the active loop antenna has a circular shape.

22. The method according to claim 18, wherein positioning the plurality of passive loop antennas comprises positioning the plurality of passive loop antennas to define a center point; and wherein the positioning the active loop antenna comprises positioning the active loop antenna so that it is concentric with the center point.

23. The method according to claim 18, wherein positioning the plurality of passive loop antennas comprises positioning the plurality of passive loop antennas on a first side of the substrate; and wherein positioning the active loop antenna comprises positioning the active loop antenna on a second side of the substrate.

* * * * *